US006210212B1

(12) United States Patent
Niece

(10) Patent No.: US 6,210,212 B1
(45) Date of Patent: Apr. 3, 2001

(54) COMPUTER HEADPHONE EXTENSION CORD DEVICE

(76) Inventor: Timothy Niece, 168 Strawberry Hill, Woodbridge, NJ (US) 07095

( * ) Notice: Subject to any disclaimer, the term of this patent is extended or adjusted under 35 U.S.C. 154(b) by 0 days.

(21) Appl. No.: 09/244,144

(22) Filed: Feb. 4, 1999

(51) Int. Cl.[7] ..... H01R 11/00
(52) U.S. Cl. ..... 439/502; 439/638
(58) Field of Search ..... 439/502, 636, 439/638, 505

(56) References Cited

U.S. PATENT DOCUMENTS 4,097,111 * 6/1978 Martin ..... 439/638
4,944,016 * 7/1990 Christian ..... 381/74
5,812,683 * 9/1998 Parker et al. ..... 439/638
6,016,432 * 1/2000 Stein ..... 455/557

* cited by examiner

*Primary Examiner*—Brian Sircus
*Assistant Examiner*—Son V. Nguyen
(74) *Attorney, Agent, or Firm*—Ezra Sutton

(57) ABSTRACT

A computer headphone extension device for connection to the audio output port on the rear of a personal computer and for connection to a stereo mini-plug of a headphone set. The computer headphone extension device includes an elongated electrical cord having a first end and a second end. The computer headphone extension device further includes a phone jack member connected to the first end of the electrical cord for inserting the stereo mini-plug into the audio output port on the rear of the personal computer; and a receiving box device having a connecting port for connecting to the second end of the electrical cord and having a phone jack for receiving the stereo mini-plug of the headphone set.

5 Claims, 4 Drawing Sheets

COMPUTER HEADPHONE EXTENSION CORD DEVICE

FIELD OF THE INVENTION

This invention relates to a computer headphone extension cord device that is connected to the audio output port at the back of a computer. More particularly, the computer headphone extension cord device is extended to the front of the computer and has a receiving box with a phone jack therein for receiving the stereo mini plug from a headphone set.

BACKGROUND OF THE INVENTION

Present day computers (PC's) in most cases, have an audio output port on the rear wall of the PC for use with a standard set of headphones having a stereo mini plug attached to an elongated electrical cord. There are problems with this present headphone system and the rear entry position of the audio output port on the back of the PC. It limits the use of the headphone set by the PC user, wherein most of the elongated electrical cord is used in connecting the headphone set to the audio output port at the back of the PC. The PC user has only a limited amount of space in which to move about while using the headphone set, as presently depicted. Also, the PC user has the inconvenience of having to reach to the back of the computer to connect the headphone set.

There remains a need for a computer headphone extension cord device which may be easily connected to the audio output port on the back of a personal computer. The computer headphone extension cord device has an elongated electrical cord and a receiving box with a phone jack port therein which is extended to the front, of the computer where the stereo mini-plug from a headphone set is received within the phone jack port of the computer headphone extension cord.

DESCRIPTION OF THE PRIOR ART

Audio input and output connectors for computers having various designs, structures and configurations have been disclosed in the prior art. For example, U.S. Pat. No. 5,666,267 to Intel Corporation, discloses an audio input/output connector which can be installed in the front portion of a computer so that a user can connect external devices, such as an input microphone or a set of headphones into the front panel of a computer. This audio input/output connector allows a computer user to plug an external device such as a headphone into the front panel jack of a computer, as opposed to the rear panel jack, which is less accessible. This connector apparatus contains audio ports for headphones which send audio signals through an audio extension card. An audio input/ output connector receives and sends the audio signals through a flex capable and finally to another connector. The audio input/output apparatus is placed inside the hard drive bay and occupies a small fraction of the space therein, without intruding into the conventional space required by the hard drive. This prior art patent does not disclose the design, structure and configuration of the present invention.

This aforementioned prior art patent does not teach or disclose the use of a computer headphone extension cord device of the present invention that is connected to the audio output port on the rear of a personal computer having the design, structure and configuration of the present invention.

Accordingly, it is an object of the present invention to provide a computer headphone extension cord device that is connected to the audio output port on the rear of a personal computer for use with a standard set of headphones.

Another object of the present invention is to provide a computer headphone extension cord device having an elongated electrical cord and having a receiving box with a phone jack port therein at one end of the electrical cord for receiving the stereo mini-plug from a headphone set; and at the other end of the electrical cord a stereo mini-plug for inserting and connecting to the audio output port on the rear of the computer.

Another object of the present invention is to provide a computer headphone extension cord device that can be used on most computer system hardware that have an audio port station either built-in or on an expansion card (i.e. PC's, Macintosh™ computers or Sun™ work stations). This computer headphone extension cord device is not limited by internal components in existing computer system hardware.

Another object of the present invention is to provide a computer headphone extension cord device that can be attached to a computer in a detachable manner or permanently mounted.

Another object of the present invention is to provide a computer headphone extension cord device that can have extended lengths of electrical cord having specific cord lengths of 18", 24", 36", 48", 60" or 72".

Another object of the present invention is to provide a computer headphone extension cord device that can be made less expensively than an internal (headphone cord) unit in a standard PC hardware system.

Another object of the present invention is to provide a computer headphone extension cord device that is lightweight, durable, and conforms to the standards of currently manufactured personal computers.

A further object of the present invention is to provide a computer headphone extension cord device that can be mass produced in an automated and economical manner and is readily affordable by the computer user.

SUMMARY OF THE INVENTION

The present invention provides for a computer headphone extension device for connection to the audio output port on the rear of a personal computer and for connection from a stereo mini-plug of a headphone set. The computer headphone extension device includes an elongated electrical cord having a first end and a second end. The computer headphone extension device further includes a stereo mini-plug connected to the first end of the electrical cord for inserting the stereo mini-plug into the audio output port at the rear of the personal computer; and a receiving box device having a connecting port for connecting to the second end of the electrical cord and having a phone jack for receiving the stereo mini-plug of the headphone set.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT

Figure 1:
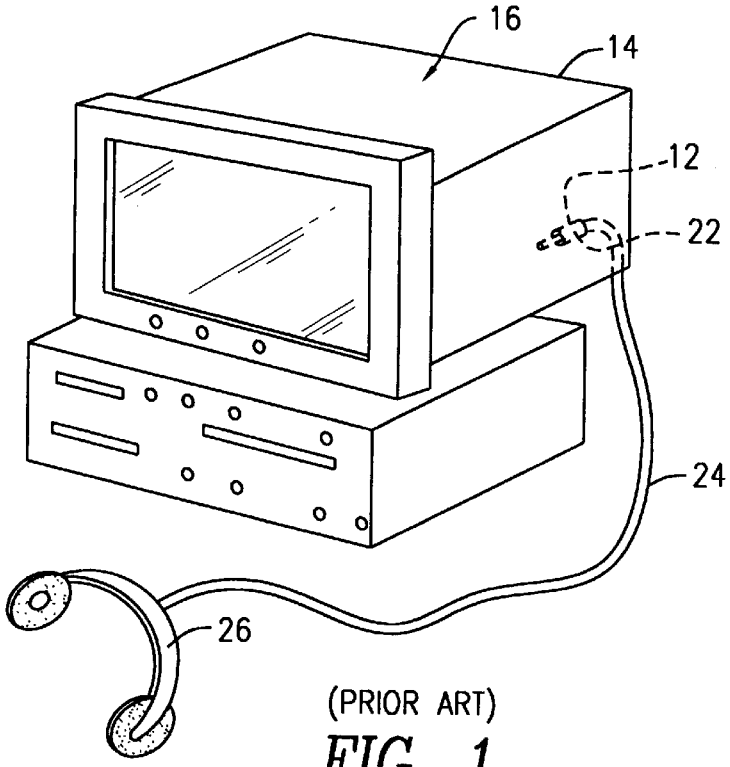
(PRIOR ART) FIG. 1
FIG. 1 is a schematic diagram of the prior art showing the use of set of headphones with a personal computer.

The computer headphone extension cord device 10 and its component parts of the preferred embodiment of the present invention are represented in detail by FIGS. 2 through 5 of the drawings. The computer headphone extension cord device 10 is used in conjunction with the audio output port 12 on the rear 14 (system board or expansion card) of a personal computer 16, such that the computer headphone extension cord device 10 is then connected to the audio jack member 22 on the electrical cord 24 of a headphone set 26.

FIG. 1 of the drawings shows the prior art of a headphone set 26 in use with a personal computer 16, such that the audio jack member 22 of headphone set 26 is connected to the audio output port 12 on the rear wall 14 of the PC 16; and also shows much of the length of the headphone electrical cord 24 is used in extending around the perimeter of the PC 16. This situation limits the use of the headphone set 26 by the computer user, wherein most of the length of electrical cord 24 is used in connecting the headphone set 26 to the audio output port 12 on the back 14 of the personal 25 computer 16. Also, the PC user has the inconvenience of having to reach the back 14 of the computer 16 to connect the headphone set 26.

Figure 3:
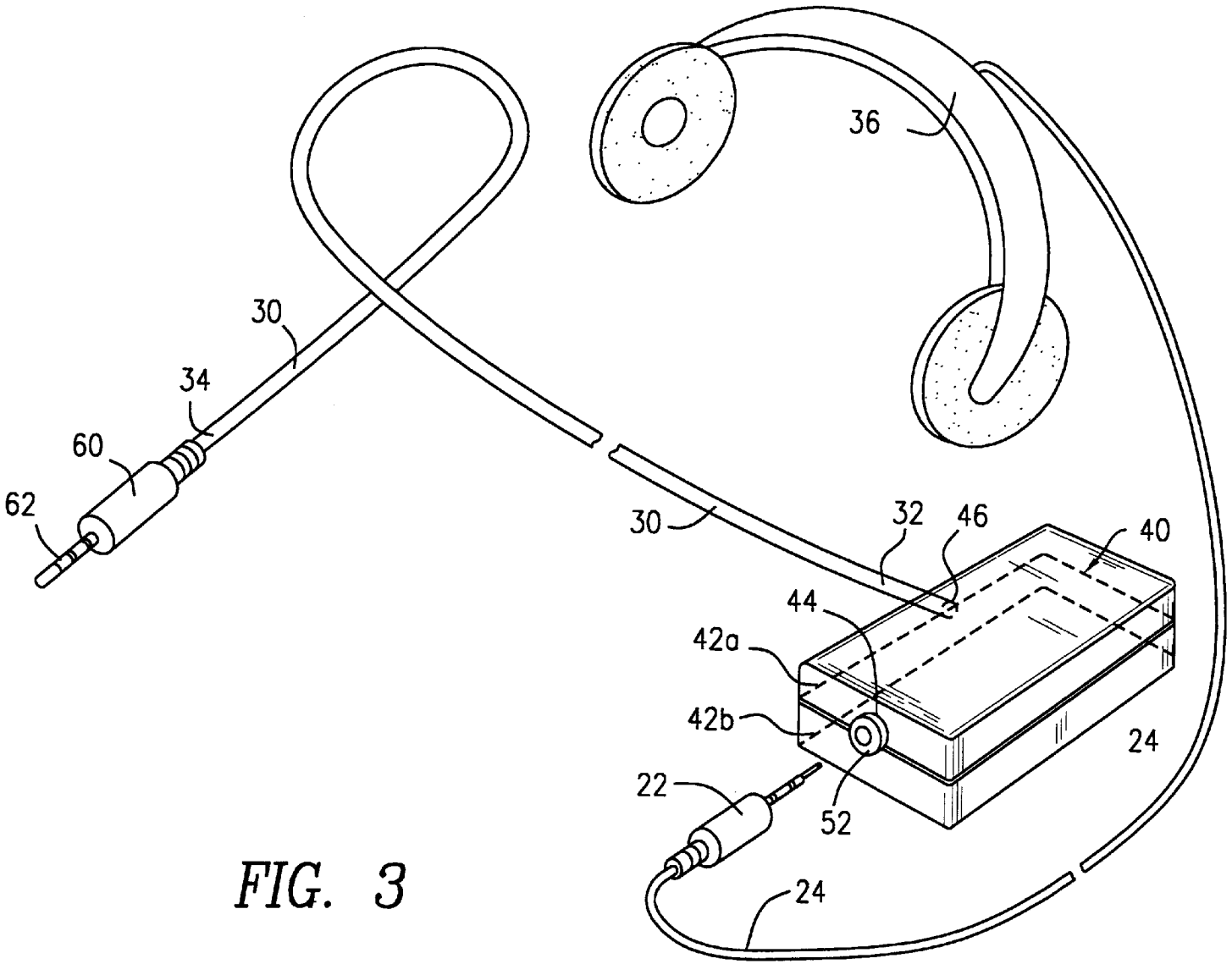
FIG. 3 is a perspective view of the computer headphone extension cord device of the preferred embodiment of the present invention showing a stereo mini-plug, an elongated electrical cord, and a receiving box device with a phone jack port therein for receiving the stereo mini-plug from a headphone set.
Figure 4:
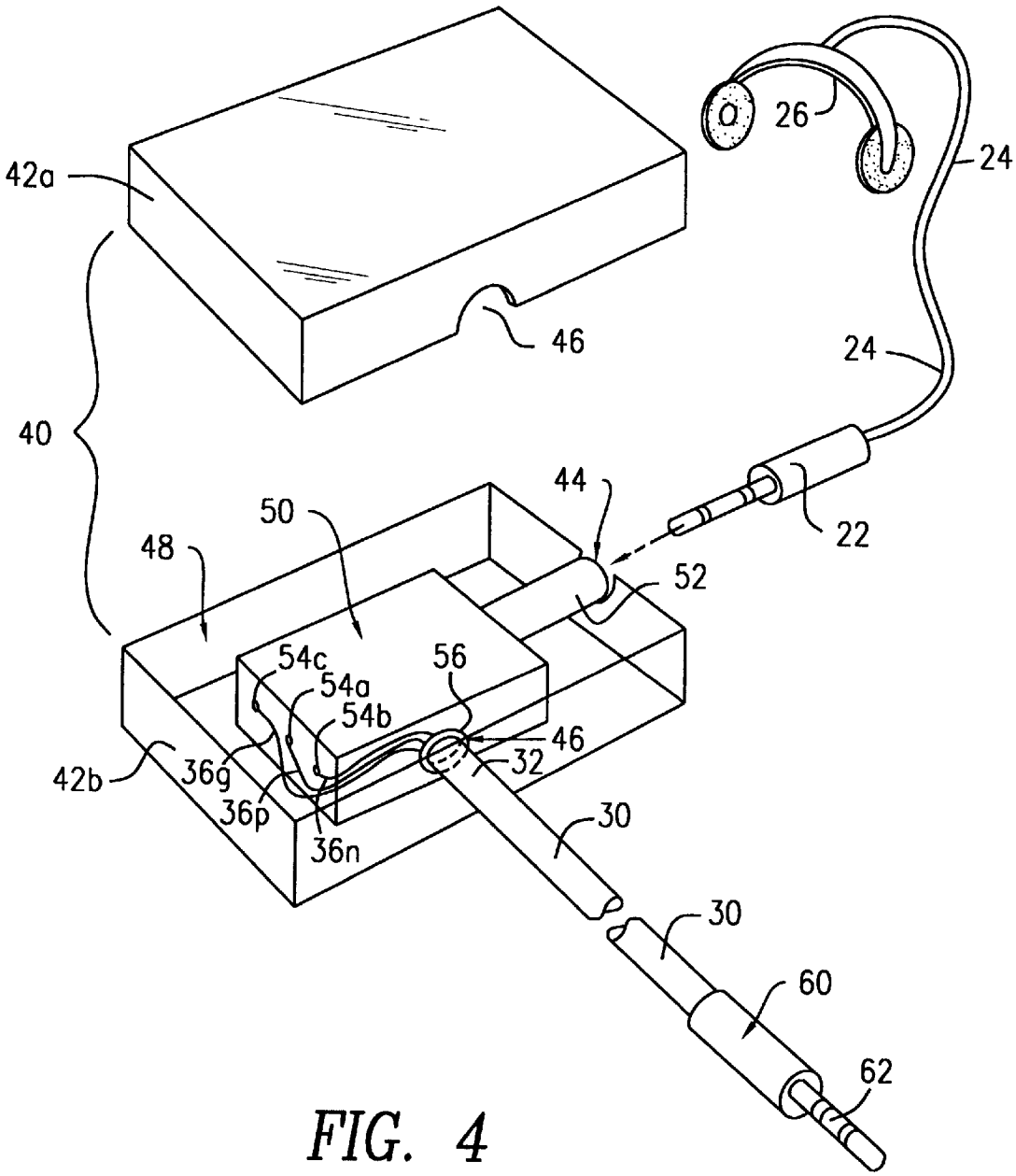
FIG. 4 is an exploded perspective view of the computer headphone extension cord device of the preferred embodiment of the present invention showing the receiving box device having a phone jack member therein.

The computer headphone extension cord device 10, as depicted in FIG. 3 of the drawings, includes an elongated and extended electrical cord 30 having a receiving box device 40 with an audio input port opening 44 therein and also having a connecting cord opening 46 therein being connected to one end 32 of electrical cord 30. The other end 34 of electrical cord 30 has a phone jack member 60 having a stereo mini-plug 62 for inserting and connecting to the audio output port 12 on the rear 14 of the PC 16. Receiving box device 40 is substantially rectangular in shape and has two half sections 42*a* and 42*b*. Receiving box 40 includes a phone jack port opening 44, a cable/connecting opening 46 for electrical cord 30 and an interior compartment 48 for holding in place a phone jack device 50. Phone jack device 50 includes a phone jack receiving member (phone jack port) 52 and a plurality of electrical wire openings 54*a*, 54*b* and 54*c* therein for receiving the positive electrical line 36*p*, the negative electrical line 36*n* and the ground electrical line 36*g*, respectively, of electrical cord 30.

Phone jack port opening 44 is used for receiving therein the phone jack receiving member (phone jack port) 52 which connects to the stereo mini-plug 22 from headphone set 26. Phone jack device 50 is a standard three-conductor (3.5 mm) closed-circuit type. An electrical wire clip 56 holds the electrical cord 30 within the interior compartment 48 of box device 40. This device can be modified to include two phone jack ports that can be used for both audio and microphone inputs.

OPERATION OF THE INVENTION

Figure 2:
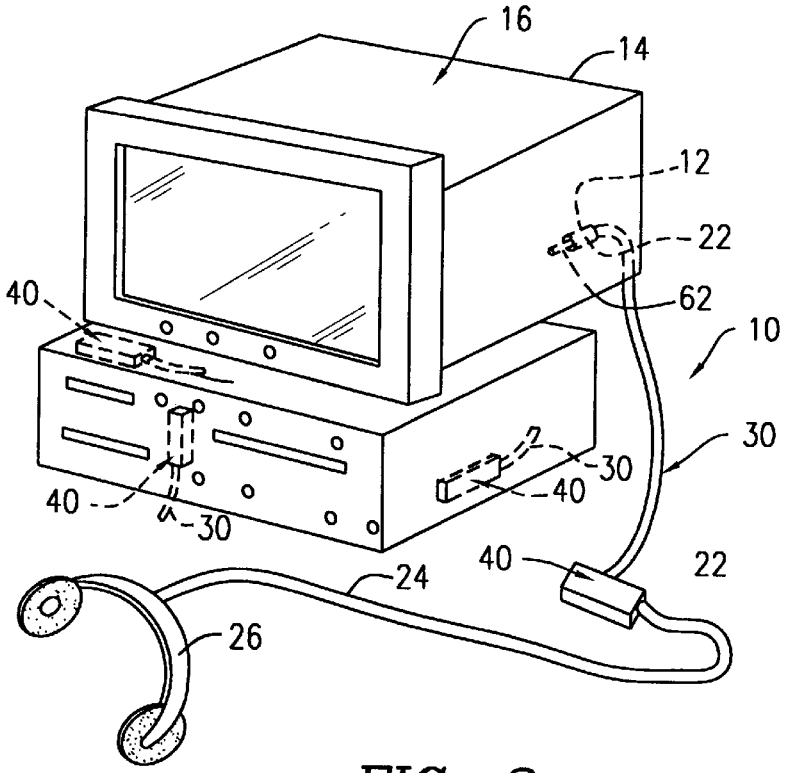
FIG. 2 is a schematic diagram of the computer headphone extension cord device of the preferred embodiment of the present invention showing the use of a set of headphones attached to the computer headphone extension cord, being in turn attached to the front, side or on-top of the personal computer.
Figure 5:
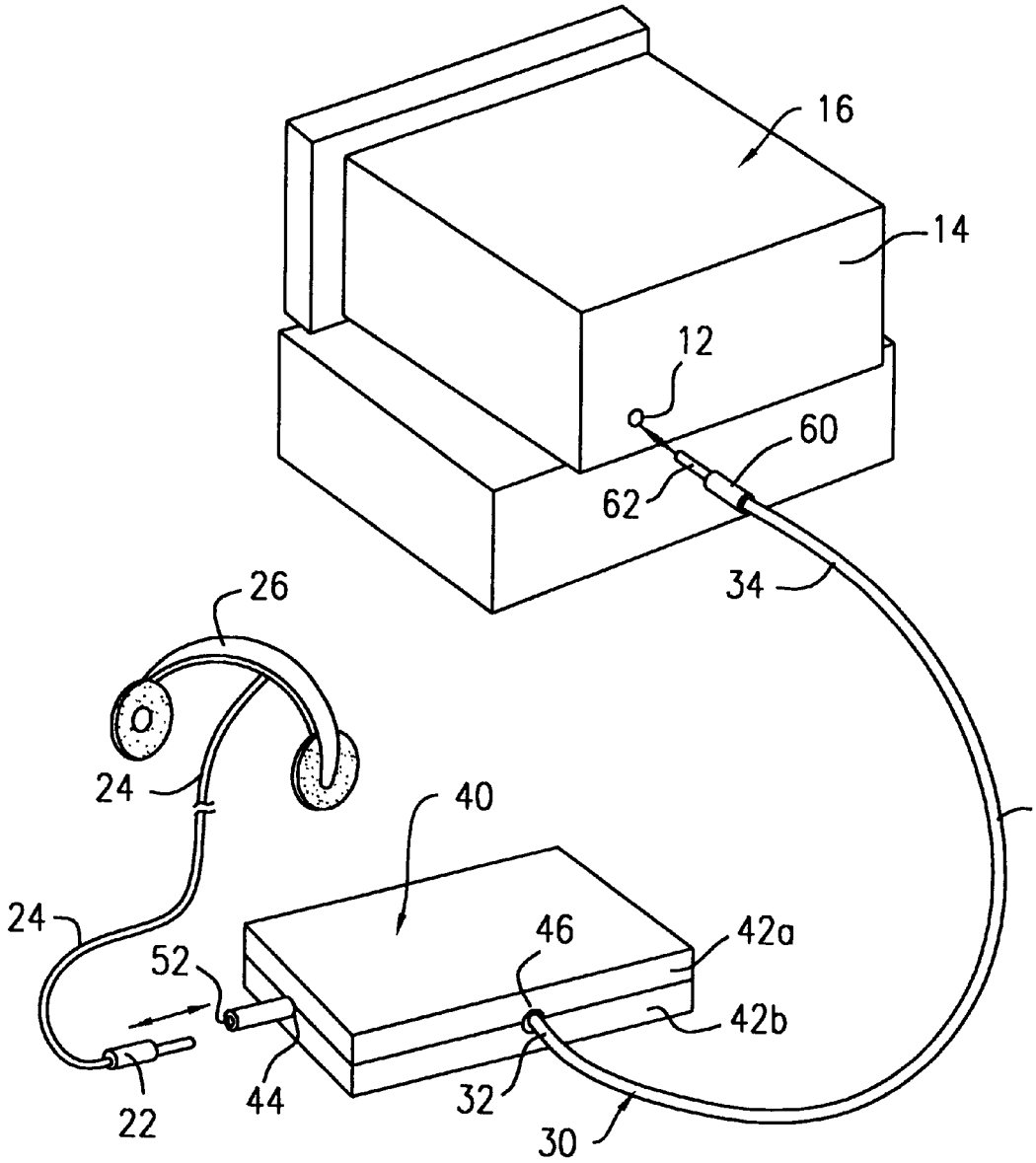
FIG. 5 is a schematic diagram of the computer headphone extension cord device of the preferred embodiment showing the computer headphone extension cord device attached to the rear of the personal computer and attached to a headphone set.

In operating the computer headphone extension cord 10 of the present invention, the user simply inserts the stereo mini-plug 62 of the audio jack member 60 into the audio output port 12 on the rear 14 of the personal computer 16, as depicted in FIGS. 2 and 5 of drawings. The user then connects the stereo mini-plug 22 on the electrical cord 24 of the headphone set 26 into the phone jack port 52 of the receiving box device 40, as shown in FIG. 5 of the drawings. In having an elongated electrical cord 30 of extended lengths (from 18" to 72"), the user can now easily move about the room(s) while using the headphone set 26, and is not limited to an area in the vicinity of the PC station 16.

ADVANTAGES OF THE PRESENT INVENTION

Accordingly, an advantage of the present invention is that it provides for a computer headphone extension cord device that is connected to the audio output port on the rear of a personal computer for use with a standard set of headphones.

Another advantage of the present invention is that it provides for a computer headphone extension cord device having an elongated electrical cord and having a receiving box with a phone jack port therein at one end of the electrical cord for receiving the stereo mini-plug from a headphone set; and at the other end of the electrical cord a stereo mini-plug for inserting and connecting to the audio output port on the rear of the computer.

Another advantage of the present invention is that it provides for a computer headphone extension cord device that can be used on most computer system hardware that have an audio port station either built-in or on an expansion card (i.e. PC's, Macintosh™ computers or Sun™ work stations). This computer headphone extension cord device is not limited by internal components in existing computer system hardware.

Another advantage of the present invention is that it provides for a computer headphone extension cord device that can be attached to a computer in a detachable manner or permanently mounted.

Another advantage of the present invention is that it provides for a computer headphone extension cord device that can have extended lengths of electrical cord having specific cord lengths of 18", 24", 36", 48", 60" or 72".

Another advantage of the present invention is that it provides for a computer headphone extension cord device that can be made less expensively than an internal (headphone cord) unit in a standard PC hardware system.

Another advantage of the present invention is that it provides for a computer headphone extension cord device that is light-weight, durable, and conforms to the standards of currently manufactured personal computers.

A further advantage of the present invention is that it provides for a computer headphone extension cord device that can be mass produced in an automated and economical manner and is readily affordable by the computer user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A computer headphone extension device for connection to an audio output port on a rear surface of a personal computer and for connection to a stereo headphone set for transferring an audio output signal from the computer to the headphone set, comprising:

a) a personal computer having an audio output port positioned on a rear surface of said personal computer;

b) an elongated electrical cord having a first end and a second end;

c) an audio jack member connected to said first end of said electrical cord for inserting said audio jack member into said audio port on said rear surface of said personal computer; and d) a receiving box device having a connecting port for connecting to said second end of said electrical cord and having a phone jack port;

said phone jack port for receiving a stereo mini-plug of a headphone set;

wherein said receiving box transfers the audio output signal from said computer to said headphone set without amplification.

2. The computer headphone extension device in accordance with claim 1, wherein said elongated electrical cord has a length dimension in a range of 18 inches to 72 inches.

3. The computer headphone extension device in accordance with claim 1, wherein said receiving box device includes a phone jack having said phone jack port connected thereto and said phone jack device includes a plurality of electrical wire openings for receiving said second end of said electrical cord therein.

4. The computer headphone extension device in accordance with claim 3, wherein said phone jack receiving member of said phone jack device is used for connecting and receiving therein the stereo mini-plug of the headphone set.

5. The computer headphone extension device in accordance with claim 3, wherein said plurality of electrical wire openings are used for connecting and receiving a positive, a negative and a ground electrical line of said second end of said electrical cord.

* * * * *